US007268729B1

(12) United States Patent
Yang

(10) Patent No.: US 7,268,729 B1
(45) Date of Patent: Sep. 11, 2007

(54) BACK-ARRAY, FULL-DIRECTION, CIRCULAR POLARIZATION ANTENNA MODULE

(76) Inventor: Meng-Chang Yang, 11F, No. 306-3, Sec. 1, Ta Tung Rd., Hsi Chih City, Taipei Hsien (TW)

( * ) Notice: Subject to any disclaimer, the term of this patent is extended or adjusted under 35 U.S.C. 154(b) by 0 days.

(21) Appl. No.: 11/373,202

(22) Filed: Mar. 13, 2006

(51) Int. Cl.
*H01Q 1/38* (2006.01)
*H01Q 21/00* (2006.01)

(52) U.S. Cl. ..... 343/700 MS; 343/893

(58) Field of Classification Search ..... 343/700 MS, 343/729, 848, 893
See application file for complete search history.

(56) References Cited

U.S. PATENT DOCUMENTS 5,165,109 A * 11/1992 Han et al. ..... 343/700 MS
2007/0046547 A1* 3/2007 Crouch ..... 343/700 MS

* cited by examiner

*Primary Examiner*—Shih-Chao Chen
(74) *Attorney, Agent, or Firm*—Leong C. Lei

(57) ABSTRACT

A back-array, full-direction, circular polarization antenna is disclosed to include a power divider, which has two input contact holes and an output contact hole respectively electrically connected to an internal circuit thereof, and two patch antennas respectively symmetrically connected to two opposite sides of the power divider to produce two electric fields with a 90-degrees phase difference kept between the mechanical degrees and the electric degrees produced by each electric field, each patch antenna having a patch-like ceramic body, a radiation metal electrode printed on one side of the patch-like ceramic body, and a metal contact pin affixed to the radiation metal electrode and the patch-like ceramic body and connected to one input contact hole of the power divider.

3 Claims, 5 Drawing Sheets

BACK-ARRAY, FULL-DIRECTION, CIRCULAR POLARIZATION ANTENNA MODULE

BACKGROUND OF THE INVENTION (a) Technical Field of the Invention

The present invention relates to an antenna module and more particularly, to a back-array, full-direction, circular polarization antenna module for use in a GPS, DAB, DTV or any of a variety of mobile electronic apparatus.

(b) Description of the Prior Art

Approaching of the user's hand, head or body to the antenna of a handheld electronic product or mobile communication apparatus may affect signal receiving or transmitting performance of the antenna, causing floating of the working frequency and instability of signal transmission or receiving.

Further, a patch antenna has a metal board for use as a ground plane, keeping the radiation pattern in a particular direction. The electric field at 90-degrees right above the antenna body is the maximum where the radiation angle is about within 0~180-degrees. When using the handheld electronic apparatus, the user must aim the patch antenna at the signal source so that the patch antenna can receive the signal from the signal source positively.

Further, because the gain of the radiation pattern of a chip or rod antenna is low, a chip or rod antenna is not practical for use in a handheld electronic product. When using a chip or rod antenna in a handheld electronic product, a frequency floating problem may occur due to the effect of the surroundings or approach of a human body, resulting in a signal receiving error.

SUMMARY OF THE INVENTION

The primary purpose of the present invention is to provide a back-array, full-direction, circular polarization antenna module, which eliminates the drawbacks of the aforesaid prior art design.

According to one aspect of the present invention, the back-array, full-direction, circular polarization antenna module comprises a power divider, which has two input contact holes and an output contact hole respectively electrically connected to the internal circuit thereof, and two patch antennas respectively symmetrically connected to two opposite sides of the power divider. Each patch antennas comprises a patch-like ceramic body, a radiation metal electrode on one side of the patch-like ceramic body, and a metal contact pin affixed to the radiation metal electrode and the patch-like ceramic body and connected to one input contact hole of the power divider.

According to another aspect of the present invention, the power divider comprises an upper metal layer, a bottom metal layer, an intermediate metal layer sandwiched between the upper metal layer and the bottom metal layer, a first dielectric layer sandwiched between the upper metal layer and the intermediate metal layer, and a second dielectric layer sandwiched between the bottom metal layer and the intermediate metal layer. The intermediate metal layer has two input contacts and one output contact at the circuit thereof. The upper and bottom metal layers and the first and second dielectric layers each have two input contact holes and an output contact hole respectively electrically connected to the input contacts and output contact of the intermediate metal layer.

According to still another aspect of the present invention, a switch type integrated circuit can be used and electrically connected to the two patch antennas to substitute for the power divider.

According to still another aspect of the present invention, the patch-like ceramic body is made of a microwave dielectric material having a dielectric constant not less than 20.

According to still another aspect of the present invention, the radiation metal electrodes of the two patch antennas extend in reversed direction.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1~5, an antenna module in accordance with the present invention is shown comprised of a power divider 1 and two patch antennas 2 and 2A.

The power divider 1 has two input contact holes 11 and one output contact hole 12 respectively electrically connected to the internal circuit thereof.

Figure 4:
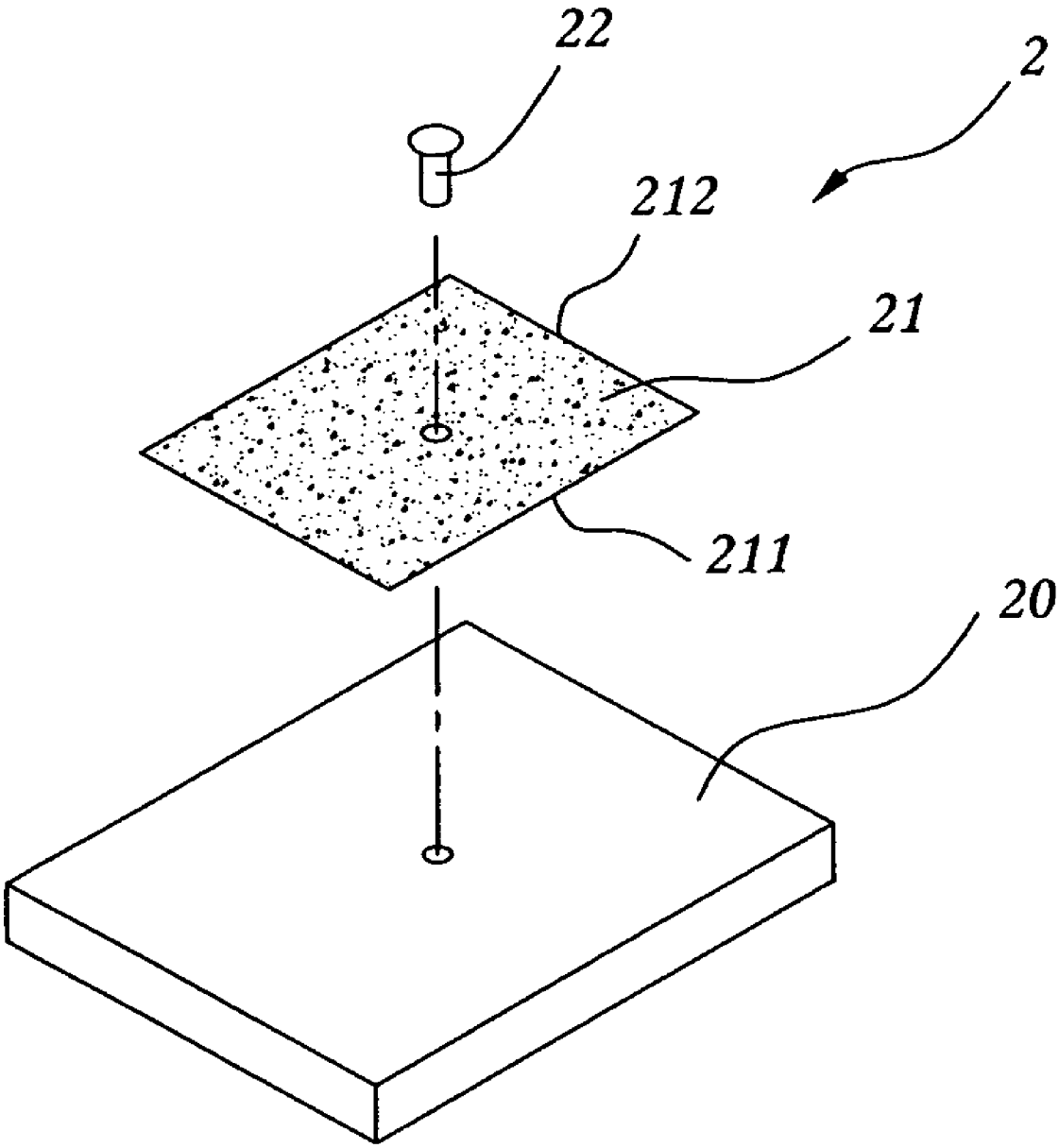
FIG. 4 is an exploded view of one patch antenna for the back-array, full-direction, circular polarization antenna module according to the present invention.
Figure 5:
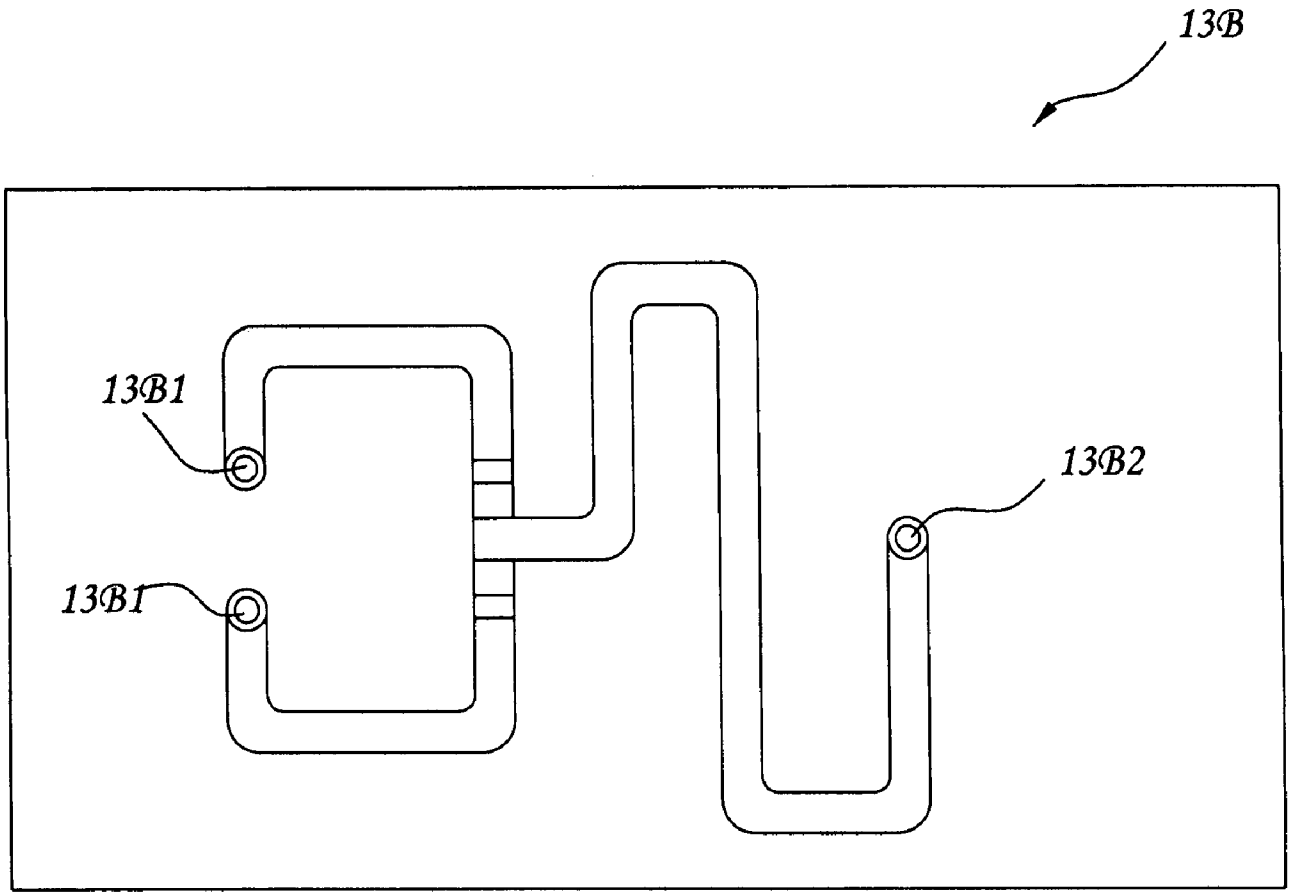
FIG. 5 is a schematic plain view showing the circuit layout of the intermediate metal layer of the power divider according to the present invention.

The two patch antennas 2 and 2A (FIG. 4 is an exploded view of the patch antenna 2) are symmetrical, each comprising a patch-like ceramic body 20, a radiation metal electrode 21, and a metal contact pin 22 or 22A (see FIG. 1) affixed to the radiation metal electrode 21 and the patch-like ceramic body 20 and protruding over the back side of the patch-like ceramic body 20. The two patch antennas 2 and 2A are symmetrically attached to the front and back sides of the power divider 1 to engage the metal contact pins 22 and 22A into the input contact holes 11. The output contact hole 12 of the power divider 1 is for connection to a GPS, DAB, DTV, or any of a variety of mobile electronic apparatus. The aforesaid patch-like ceramic body 20 is made of a microwave dielectric material having a dielectric constant greater or equal to 20 for the advantage of effectively shortens the width 211 and length 212 of the radiation metal electrode 21. The radiation metal electrode 21 can be formed on the patch-like ceramic body 20 by a printing technique.

Figure 1:
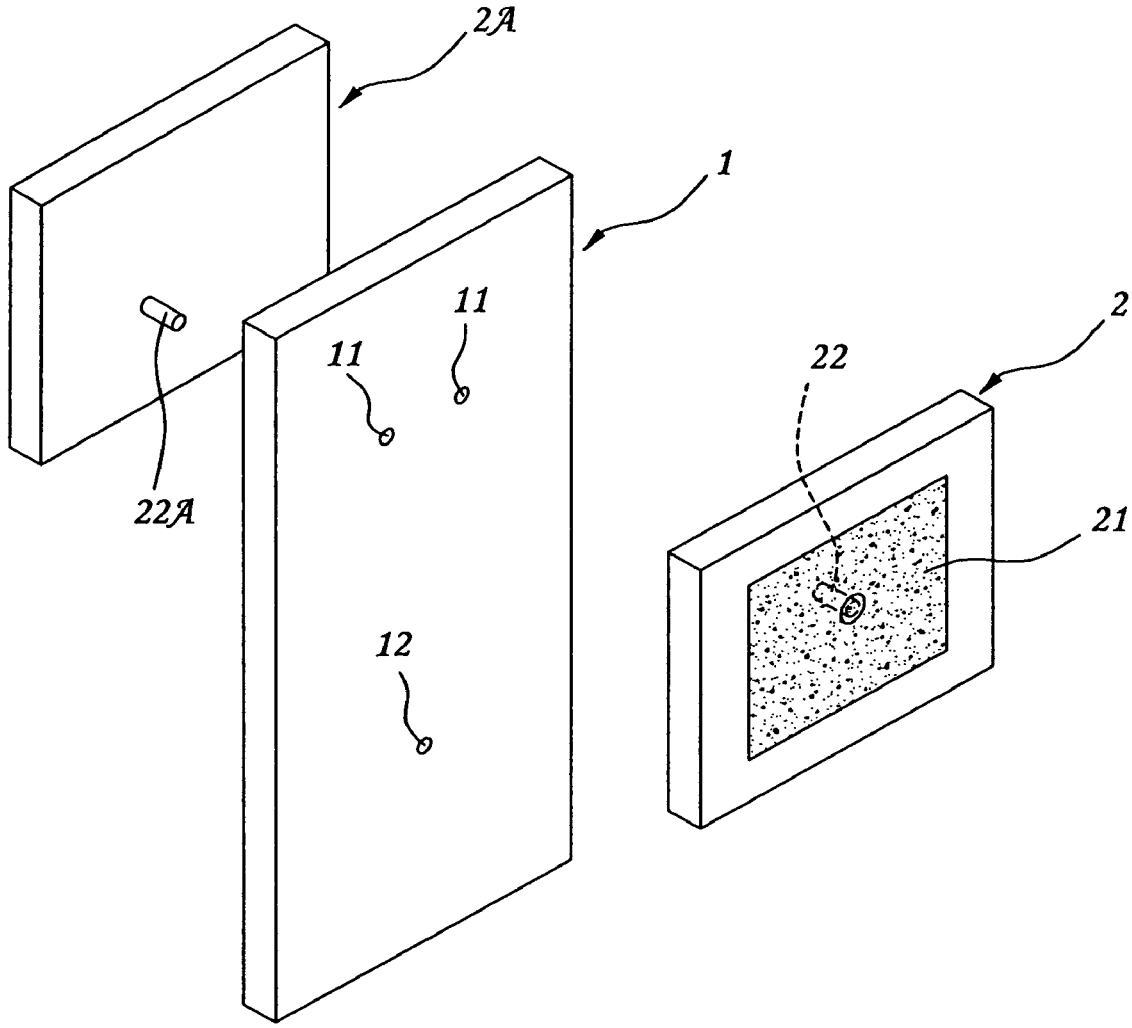
FIG. 1 is an exploded view of a back-array, full-direction, circular polarization antenna module according to the present invention.
Figure 2:
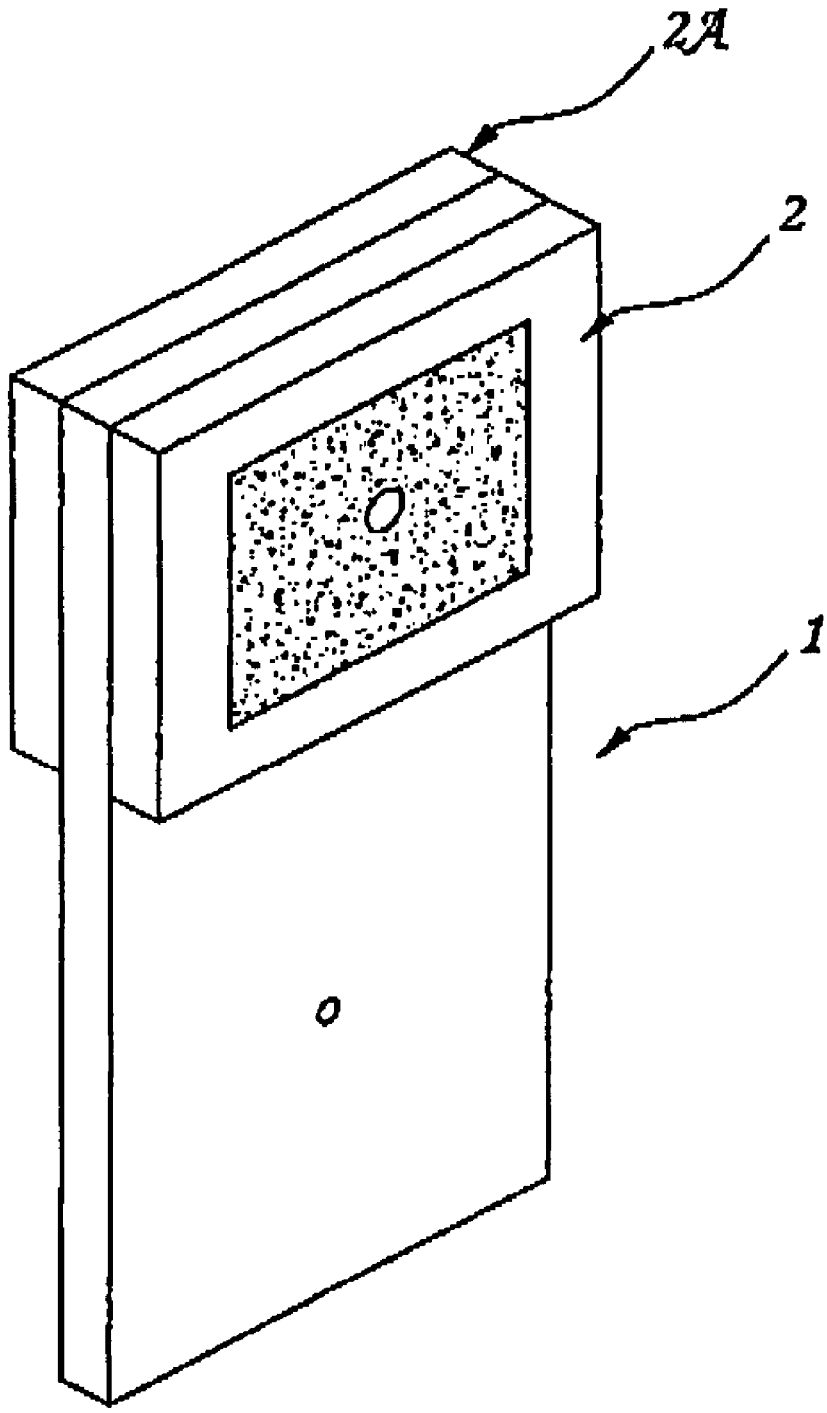
FIG. 2 is an elevational view of the back-array, full-direction, circular polarization antenna module according to the present invention.
Figure 3:
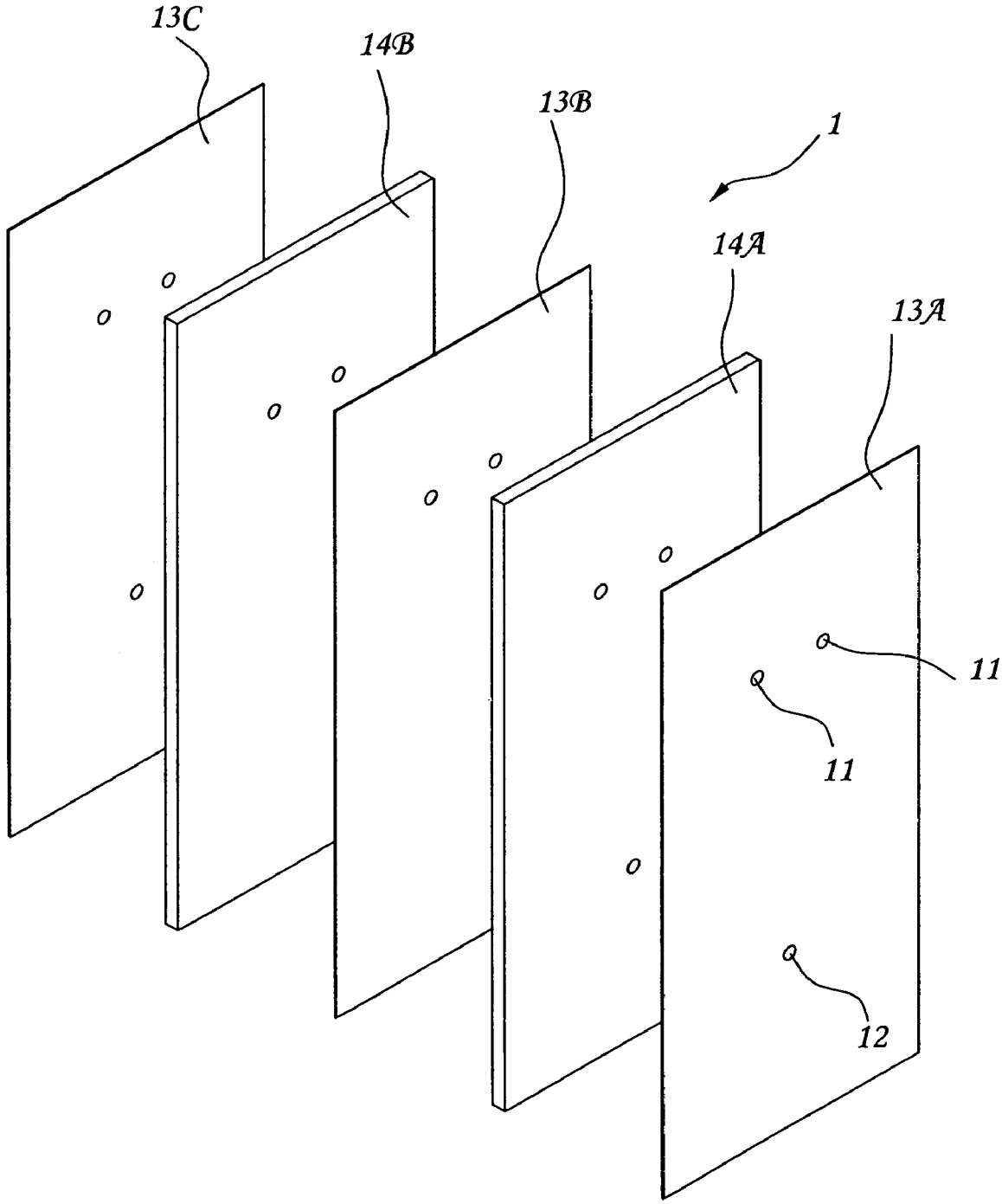
FIG. 3 is an exploded view of the power divider for the back-array, full-direction, circular polarization antenna module according to the present invention.

Referring to FIG. 3, the power divider 1 comprises an upper metal layer 13A, an intermediate metal layer 13B, a bottom metal layer 13C, a first dielectric layer 14A, and a second dielectric layer 14B. The first dielectric layer 14A is sandwiched between the upper metal layer 13A and the intermediate metal layer 13B. The second dielectric layer 14B is sandwiched between the bottom metal layer 13C and the intermediate metal layer 13B. The metal layers 13A and 13C and the dielectric layers 14A and 14B each have two input contact holes 11 and one output contact hole 12 respectively electrically connected to respective input contacts 13B1 and output contact 13B2 of the intermediate metal layer 13B (see FIG. 5). The upper metal layer 13A and the bottom metal layer 13C work as a ground plane of the power divider 1.

The power divider 1 is a multi-layer PC board design using the intermediate metal layer 13B to design a one-to-two sandwiched strip. When the two patch antennas 2 receive a signal respectively, the received signals are transmitted to the input contact holes 11 of the power divider 1 and then synthesized by the power divider 1 for output to the system through the output contact hole 12.

The antenna module of the present invention can be a circular polarization design or linear polarization design, practical for use in a GPS, DAB, DTV, or any of a variety of mobile electronic apparatus. The microwave dielectric material for the ceramic body of each patch antenna can be high-frequency ceramic powder or any dielectric material suitable for high-frequency antenna. If a circular polarization design is desired, a radiation metal electrode is directly printed on the ceramic body to produce two electric fields, keeping a 90-degrees phase difference between the mechanical degrees and the electric degrees produced by each electric field. Thus, one single patch antenna has the electric field characteristics of a circular polarization. The two patch antennas are arranged back to back, thereby configuring a full-direction and high gain antenna radiation pattern. The power divider that is sandwiched between the two patch antennas synthesizes the signals received from the two patch antennas, and then transmits the synthesized signal to the system.

Further, a switch type integrated circuit (not shown) may be used to substitute for the power divider 1, achieving the same effect.

A prototype of back-array, full-direction, circular polarization antenna module has been constructed with the features of FIGS. 1~5. The back-array, full-direction, circular polarization antenna module functions smoothly to provide all of the features disclosed earlier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A back-array, full-direction, circular polarization antenna module comprising:

a power divider, said power divider having two input contact holes and an output contact hole respectively electrically connected to an internal circuit thereof; and two patch antennas respectively symmetrically connected to two opposite sides of said power divider, said patch antennas each comprising a patch-like ceramic body, a radiation metal electrode on one side of said patch-like ceramic body, and a metal contact pin affixed to said radiation metal electrode and said patch-like ceramic body and connected to one input contact hole of said power divider;

wherein said power divider comprises an upper metal layer, a bottom metal layer, an intermediate metal layer sandwiched between said upper metal layer and said bottom metal layer, a first dielectric layer sandwiched between said upper metal layer and said intermediate metal layer, and a second dielectric layer sandwiched between said bottom metal layer and said intermediate metal layer, said intermediate metal layer having two input contacts and one output contact at a circuit thereof, said upper and bottom metal layers and said first and second dielectric layers each having two input contact holes and an output contact hole respectively electrically connected to the input contacts and output contact of said intermediate metal layer.

2. The back-array, full-direction, circular polarization antenna module as claimed in claim 1, wherein said patch-like ceramic body is made of a microwave dielectric material having a dielectric constant not less than 20.

3. The back-array, full-direction, circular polarization antenna module as claimed in claim 1, wherein the radiation metal electrodes of said two patch antennas extend in reversed direction.

* * * * *